US006796478B2

(12) United States Patent
Shkolnikov et al.

(10) Patent No.: US 6,796,478 B2
(45) Date of Patent: Sep. 28, 2004

(54) FUEL CELL ADAPTER SYSTEM FOR COMBUSTION TOOLS

(75) Inventors: Yury Shkolnikov, Glenview, IL (US); Tony Deieso, Wadsworth, IL (US); Walter J. Taylor, McHenry, IL (US); Sandra J. Wilson, Hawthorn Woods, IL (US); William N. Roberts, Grayslake, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/014,706

(22) Filed: Nov. 13, 2001

(65) Prior Publication Data

US 2002/0043547 A1 Apr. 18, 2002

Related U.S. Application Data

(63) Continuation-in-part of application No. 09/689,546, filed on Oct. 12, 2000, now Pat. No. 6,523,860.

(51) Int. Cl.[7] ..... B25C 1/08

(52) U.S. Cl. ..... 227/10; 227/9; 227/130; 285/4

(58) Field of Search ..... 285/3, 4, 360, 285/328, 376, 330; 227/130, 8

(56) References Cited

U.S. PATENT DOCUMENTS

| | | | | |
|---|---|---|---|---|
| 1,221,650 A | | 4/1917 | Atkins et al. | |
| 3,035,617 A | | 5/1962 | Breitenstein | |
| 3,654,965 A | * | 4/1972 | Gramain | 138/89 |
| 3,858,910 A | | 1/1975 | Oetiker | |
| 3,907,012 A | | 9/1975 | Burke | |
| 3,978,844 A | | 9/1976 | Wilkens | |
| 4,065,029 A | | 12/1977 | Chernock | |
| 4,094,384 A | | 6/1978 | Heilmann | |
| 4,218,888 A | * | 8/1980 | Jayne | 60/632 |
| 4,449,737 A | * | 5/1984 | Specht | 285/7 |
| 4,483,473 A | | 11/1984 | Wagdy | |
| 4,483,474 A | * | 11/1984 | Nikolich | 227/8 |
| 4,491,060 A | | 1/1985 | Boski | |
| 4,712,379 A | * | 12/1987 | Adams et al. | 60/632 |
| 4,717,060 A | * | 1/1988 | Cotta | 227/10 |
| 4,739,915 A | * | 4/1988 | Cotta | 227/10 |
| 4,751,452 A | * | 6/1988 | Kilmer et al. | 320/106 |
| 4,878,595 A | * | 11/1989 | Uhlig | 206/807 |
| 4,902,043 A | * | 2/1990 | Zillig et al. | 138/89 |
| 4,905,576 A | | 3/1990 | Reynolds | |
| 4,911,194 A | * | 3/1990 | Lechner | 137/614.04 |
| 4,971,224 A | | 11/1990 | Scremin | |
| 4,995,643 A | * | 2/1991 | Rappart et al. | 285/30 |
| 5,029,730 A | | 7/1991 | Kostecki et al. | |
| 5,070,858 A | | 12/1991 | Wang | |

(List continued on next page.)

FOREIGN PATENT DOCUMENTS

| | | |
|---|---|---|
| EP | 0 936 031 | 8/1999 |
| EP | 1 197 299 | 4/2002 |
| FR | 826.699 | 6/1938 |
| GB | 1 311 322 | 3/1973 |

*Primary Examiner*—Scott A. Smith
*Assistant Examiner*—Paul Durand
(74) *Attorney, Agent, or Firm*—Lisa M. Soltis; Mark W. Croll; Donald J. Breh

(57) ABSTRACT

A fuel cell adapter system for a combustion tool which includes a housing enclosing a fuel metering valve. The fuel cell is provided with an adapter having a generally cylindrical nozzle and an enlarged base configured for engagement upon the fuel cell. The nozzle has a lobed free end and defines a passageway. A frangible membrane is provided for blocking the passageway. The latch is disposed in the housing for releasably securing the adapter in fluid communication with the fuel metering valve. The latch includes a latch body having at least one locking tang movable between a closed position and an open position, and a release member for moving the locking tang to release the engagement with the adapter and permitting withdrawal of said fuel cell from said tool. A modified latch receives the adapter of the fuel cell in a push-and-twist motion to retain it in position.

12 Claims, 9 Drawing Sheets

U.S. PATENT DOCUMENTS 5,213,247 A * 5/1993 Gschwend et al. ..... 227/10
5,263,439 A 11/1993 Doherty et al.
5,484,088 A * 1/1996 Martin ..... 222/402.2
5,567,074 A * 10/1996 Dovak et al. ..... 285/3
5,680,980 A 10/1997 Robinson
5,687,899 A * 11/1997 Dohi et al. ..... 227/10
5,800,940 A * 9/1998 Bunyea et al. ..... 429/97
5,911,443 A * 6/1999 Le Quere ..... 285/23
5,927,563 A * 7/1999 Kellner ..... 222/402.22
5,954,345 A * 9/1999 Svoboda et al. ..... 16/2.3
5,979,867 A * 11/1999 Ortiz Godinez ..... 137/75
5,988,039 A 11/1999 Denchfield et al.
6,016,945 A 1/2000 Phillips et al.
6,019,072 A * 2/2000 Phillips et al. ..... 123/46 H
6,032,833 A 3/2000 Olegnowicz
6,032,835 A 3/2000 Burt
6,032,836 A 3/2000 Hiscocks et al.
6,053,005 A * 4/2000 Boitnott ..... 137/384
6,058,960 A * 5/2000 Kopp ..... 137/68.11
6,085,945 A * 7/2000 Fransen ..... 222/402.18
6,109,165 A * 8/2000 Velan et al. ..... 92/23
6,139,359 A * 10/2000 Fuhreck et al. ..... 439/500
6,181,032 B1 * 1/2001 Marshall et al. ..... 307/150
6,217,085 B1 * 4/2001 Toulouse ..... 285/319
6,223,966 B1 * 5/2001 Nayrac et al. ..... 227/130
6,286,553 B1 * 9/2001 Morgan ..... 138/89
6,302,297 B1 * 10/2001 Richardson et al. ..... 222/1
6,321,742 B1 * 11/2001 Schmidt et al. ..... 126/38
6,371,338 B1 4/2002 Klein et al.
6,419,168 B1 * 7/2002 Thieleke et al. ..... 239/337
6,463,894 B2 * 10/2002 Hasler et al. ..... 123/46

* cited by examiner-

FUEL CELL ADAPTER SYSTEM FOR COMBUSTION TOOLS

CROSS-REFERENCES TO RELATED APPLICATIONS

This application is a continuation-in-part of application Ser. No. 09/689,546 filed Oct. 12, 2000, now U.S. Pat. No 6,523,860.

BACKGROUND OF THE INVENTION

This invention relates to improvements in fuel cell adapter systems for use in combustion tools. As exemplified in Nikolich U.S. Pat. Nos. 4,403,722, 4,483,474, 4,522,162, and 5,115,944, all of which are incorporated by reference, it is known to use a dispenser to dispense a hydrocarbon fuel to a combustion gas-powered tool, such as, for example, a combustion gas-powered fastener-driving tool. Such fastener-driving tools and such fuel cells are available commercially from ITW-Paslode (a division of Illinois Tool Works, Inc.) of Vernon Hills, Ill., under its IMPULSE trademark. In particular, a suitable fuel cell is described in Nikolich U.S. Pat. No. 5,115,944, listed above.

A standard system for attaching a fuel cell to a combustion tool is known, i.e. placing the fuel cell into the combustion tool with a metering unit, and having no adapter. This system has the advantage of being compact, however it does not protect the female metering unit inlet from dirt and other debris. Also, when not using an adapter, a protective cap or blister pack is needed for transporting the fuel cell.

There is another known fuel cell attachment system for combustion tools, where a seal support attaches to a fuel cell and creates a seal for joining the fuel cell stem and a male joiner from the combustion tool. However, this adapter system does not protect the fuel cell from dirt and other debris. Another disadvantage is that the presence of this adapter alone is believed to diminish the life and capacity of the fuel cell. Still another unwanted characteristic of this adapter is that it can be removed from its current fuel cell and reused with a generic fuel cell.

One disadvantage of conventional combustion tool fuel cells is that the conventional alignment structures employed for aligning the corresponding stems or passageways of the fuel cell and the tool fuel metering valve do not provide consistent coaxial alignment of these passageways, which may lead to wasted fuel, shortened fuel cell life and less than optimal tool performance.

Another disadvantage of conventional combustion tool fuel cells is that in some cases, users may be tempted to refill spent fuel cells with generic fuel. This may impair the operation of the tool. Thus, there is a need for an adapter for a combustion tool fuel cell which is configured to discourage refilling.

Accordingly, one object of the present invention is to provide an improved fuel cell attachment system that protects the fuel cell from dirt and other debris while in use.

Another object is to provide an improved fuel cell adapter that protects the fuel cell stem during transportation, thus eliminating the need for a protective cap or blister pack.

A further object is to provide an improved fuel cell adapter that is able to provide visual identification of whether the fuel cell is unused or not.

Yet another object of the present invention is to provide an improved combustion tool featuring a latch inside the combustion tool that releasably holds the fuel cell in an engaged position.

Still another object of the present invention is to provide an improved adapter for a fuel cell that cannot be removed from a fuel cell and reused with a generic fuel cell.

A still further object of the present invention is to provide an improved adapter for a fuel cell which inhibits refilling of existing spent fuel cells.

One more object of the present invention is to provide an improved locking system for a tool which lockingly receives the fuel cell adapter and releasably locks the adapter in proper operational position within the tool.

BRIEF SUMMARY OF THE INVENTION

The above-listed objects are met or exceeded by the present fuel cell adapter system for a combustion tool which features an adapter having a frangible membrane on its free end to protect the fuel cell during transportation, a gripping formation configured for engagement with a latch, and a latching feature inside the combustion tool which releasably secures the fuel cell in engagement with the internal tool fuel metering valve. The present latching feature keeps the whole system compact in size and facilitates installation and removal of the fuel cell. In addition, lobes on the front surface of the adapter are configured to align the mating fuel metering stem axially with the fuel cell housing. Another feature of the present fuel cell adapter for a combustion tool is an enlarged base which, when mechanically compressed, fits inside the rim of the fuel cell housing to form a fixed attachment between the fuel cell adapter and the fuel cell housing. An additional feature of the present invention is a set of breakable ribs which undergo shear failure upon attempted removal of the fuel cell adaptor from the fuel cell housing.

In addition to protecting the fuel cell during transportation, the present adapter system also protects the fuel cell from dirt and debris while in use with the combustion tool. The lobes located on the front surface of the fuel cell adapter prevent a wholly flush contact surface between the front surface of the fuel cell adapter and the surface of the fuel cell to enable the removal of dirt, debris, and other impurities from the location of engagement. Further, the frangible membrane on the adapter visually indicates whether the fuel cell is unused.

Another advantage of the present invention is that, if an attempt is made to remove the present adapter from the fuel cell, the connecting ribs of the fuel cell adapter undergo shear failure, causing the nose portion of the fuel cell adapter to become separated or otherwise structurally weakened from the base portion of the fuel cell adapter, which remains mechanically fastened to the fuel cell. Upon shear failure of the ribs, the fuel cell adapter cannot be reused on another fuel cell. This feature reduces the chance for the introduction of dirt, debris, or impurities that can interfere with the connection during reuse.

Another feature of the present system is a locking mechanism on the tool which receives the adapter and releasably locks it in place in the proper operational position. Once the fuel cell is empty, in the preferred embodiment, the user merely rotates the fuel cell to overcome the locking force, and easily pulls the fuel cell from the tool.

More specifically, the present invention provides a fuel cell adapter configured for connection to a fuel cell which is engageable upon a fuel metering valve of a combustion tool including an adapter body having a base configured for engagement upon the fuel cell and a nozzle connected to the base, the nozzle having a lobed free end configured for facilitating engagement upon the valve.

The present invention also provides an enlarged base which attaches the fuel cell adapter to the rim of the fuel cell can. When the fuel cell adapter is mechanically pressed to fit into the fuel cell can, a peripheral wedge on the base of the fuel cell adapter mates with a lip on the underside of the rolled seam located on the inside diameter of the fuel cell can.

Another embodiment of the present invention is a fuel cell adapter configured for connection to a fuel cell, including an adapter body having a generally cylindrical nozzle and a base configured for engagement upon the fuel cell, with the nozzle being connected to the base. The adapter body also has a gripping formation configured for engagement with a latch.

The nozzle has a plurality of lugs, a plurality of lobes, and a plurality of support ribs. Each lug has a ramped configuration, extending from the free end toward the base, and has a truncated lug end. The plurality of lobes are chamfered to guide the mating adapter and fuel cell into axial alignment. The support ribs each have a truncated rib end and are configured for connecting the nozzle to the base.

The present invention further provides a combustion tool including a housing which encloses a fuel metering valve and a fuel cell provided with an adapter configured for being accommodated in the housing for fluid communication with the metering valve. A latch is disposed in the housing for releasably securing the adapter in fluid communication with the metering valve. The latch includes a latch body having at least one locking tang movable between a closed position and an open position. There is also a release member for moving the locking tang to release the engagement with the adapter and permitting withdrawal of the fuel cell from the tool.

DETAILED DESCRIPTION OF THE INVENTION

Figure 1:
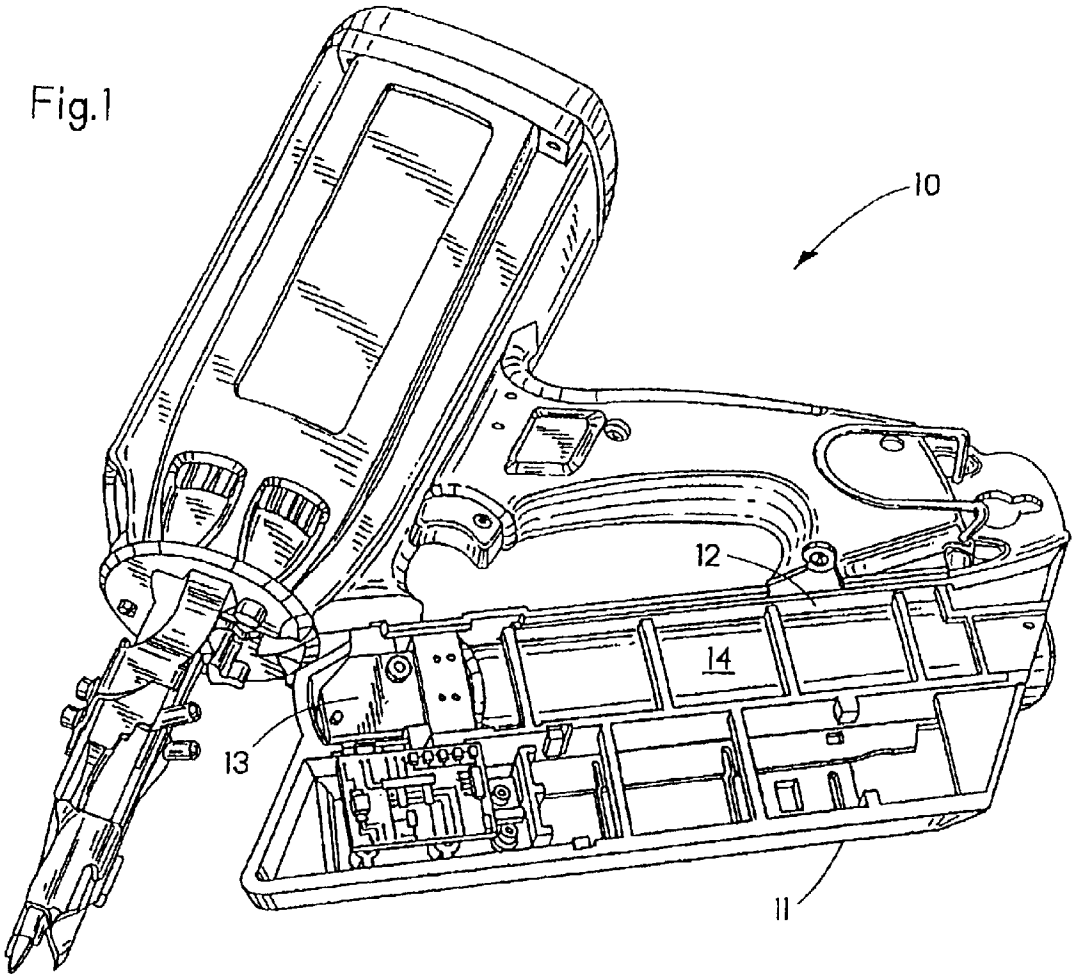
FIG. 1 is a perspective view of a combustion tool incorporating the present invention.

Referring now to FIG. 1, a combustion-powered tool of the type suitable for use with the present invention is generally designated 10. The tool 10 includes a housing 11 enclosing a fuel metering valve 13, and a fuel cell chamber 12 which releasably houses a fuel cell 14. The construction and operation of the tool 10 is described in detail in the patents incorporated by reference and referred to above.

Figure 2:
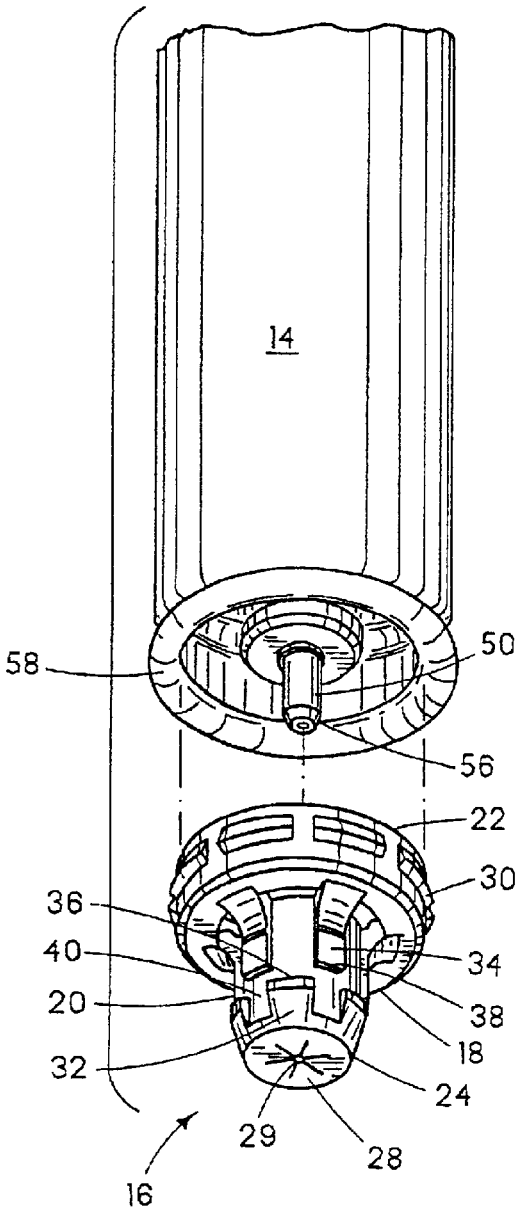
FIG. 2 is a fragmentary exploded perspective view of the present adapter and the fuel cell.
Figure 3:
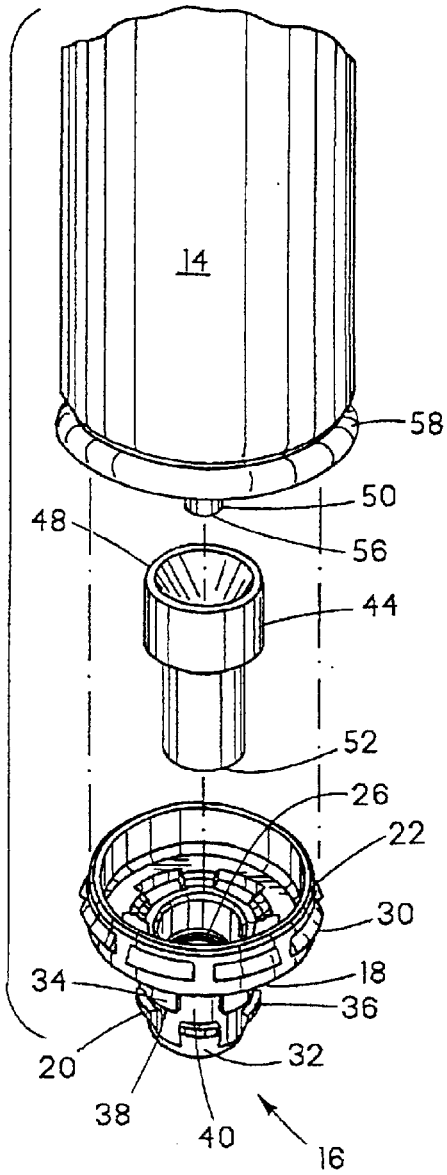
FIG. 3 is a fragmentary exploded perspective view of the present adapter, the molded insert seal and the fuel cell.

In FIGS. 2 and 3, a fuel cell adapter, generally designated 16, is configured for connection to the fuel cell 14, and facilitates engagement of the fuel cell in the fuel cell chamber 12. An adapter body 18 has a generally cylindrical nozzle 20 and a base 22 configured for engagement upon the fuel cell 14, and the nozzle is connected to the base. The nozzle 20 has a free end 24 and defines a passageway 26, with a frangible membrane 28 blocking the passageway 26. This frangible membrane 28 has a hole 29 that allows for air escape, and it is preferably disposed at or adjacent the free end 24 of the nozzle 22 for visually indicating tampering when ruptured. However, other locations along the passageway 26 are contemplated for the membrane 28. In a preferred embodiment, the diameter of the hole 29 measures about 0.010 inches, however the size of the diameter may vary depending on the application. On the adapter body 18, the nozzle 20 has a plurality of lugs 32, and a plurality of support ribs 34. The lugs 32 each have a ramped configuration, extending in an inclined configuration from the free end 24 toward the base 22, and each has a truncated lug end 36. The generally L-shaped support ribs 34 each have a truncated rib end 38, and are configured for connecting the nozzle 20 to the base 22. In the preferred embodiment, individual lugs 32 and support ribs 34 are circumferentially spaced from each other, and the spacing of the lugs relative to the support ribs 34 is staggered, so that the lugs and support ribs are not in axial alignment with each other.

In the preferred embodiment, the adapter 16 is provided with a gripping formation 40 which is configured for being engaged by a latch disposed in the fuel cell chamber 12 of the housing 11. This gripping formation 40 may have a variety of shapes. In the embodiment depicted in FIGS. 2–4, corresponding truncated lug ends 36 and the rib ends 38 of the lugs 32 and the support ribs 34 define a groove-shaped gripping formation 40 that is disposed on the nozzle 20. Although it is preferred that the adapter body 18 have a gripping formation 40 in the form of a groove as just described, it is also contemplated that the gripping formation is alternatively a rib or protrusion, generally radially extending from the adapter body 18. Such protrusions may form an annular rib or may also be individual, spaced, lugs or rib segments.

Also in a preferred embodiment, the lugs 32 are radially spaced relative to each other, and the support ribs are radially spaced relative to each other. The lugs 32 are also axially skewed, in other words, are not axially aligned relative to the opposing corresponding support ribs 34. Thus, as depicted in FIGS. 2 and 3, a staggered relationship is defined between the lugs 32 and the support ribs 34.

There is at least one barb 30 formed on the base 22 configured for frictionally engaging the fuel cell 14. In a preferred embodiment, there are a plurality of barbs 30 disposed in a radially extending fashion around the exterior of the base 22.

Figure 7:
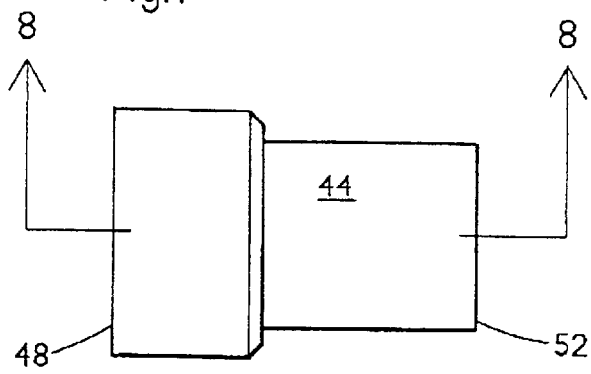
FIG. 7 is an elevational view of the molded insert.
Figure 8:
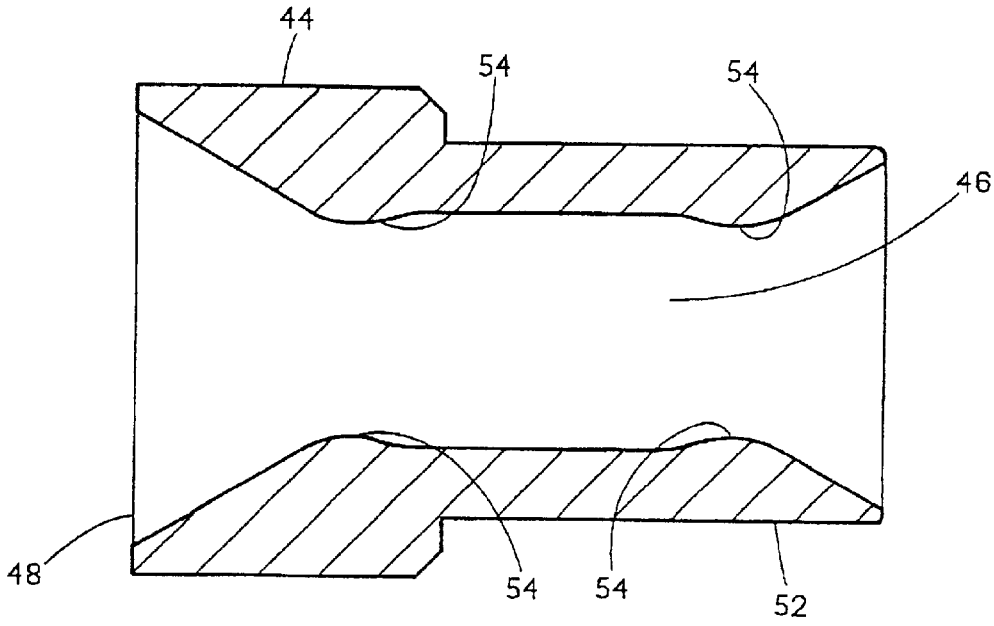
FIG. 8 is a sectional view taken along the line 8—8 of FIG. 7 and in the direction generally indicated.

As shown in FIGS. 3, 7, and 8, the adapter body 18 houses a molded insert seal 44 which fits in the passageway 26. The molded insert seal 44 defines an axial passageway 46 (best seen in FIG. 8), and has a first end 48 configured for receiving a fuel cell stem 50, and a second end 52 provided with a pair of internal sealing rings 54 which are located in the axial passageway. It will be seen that, in the preferred embodiment, the first end 48 has a larger diameter than the second end 52.

Figure 4:
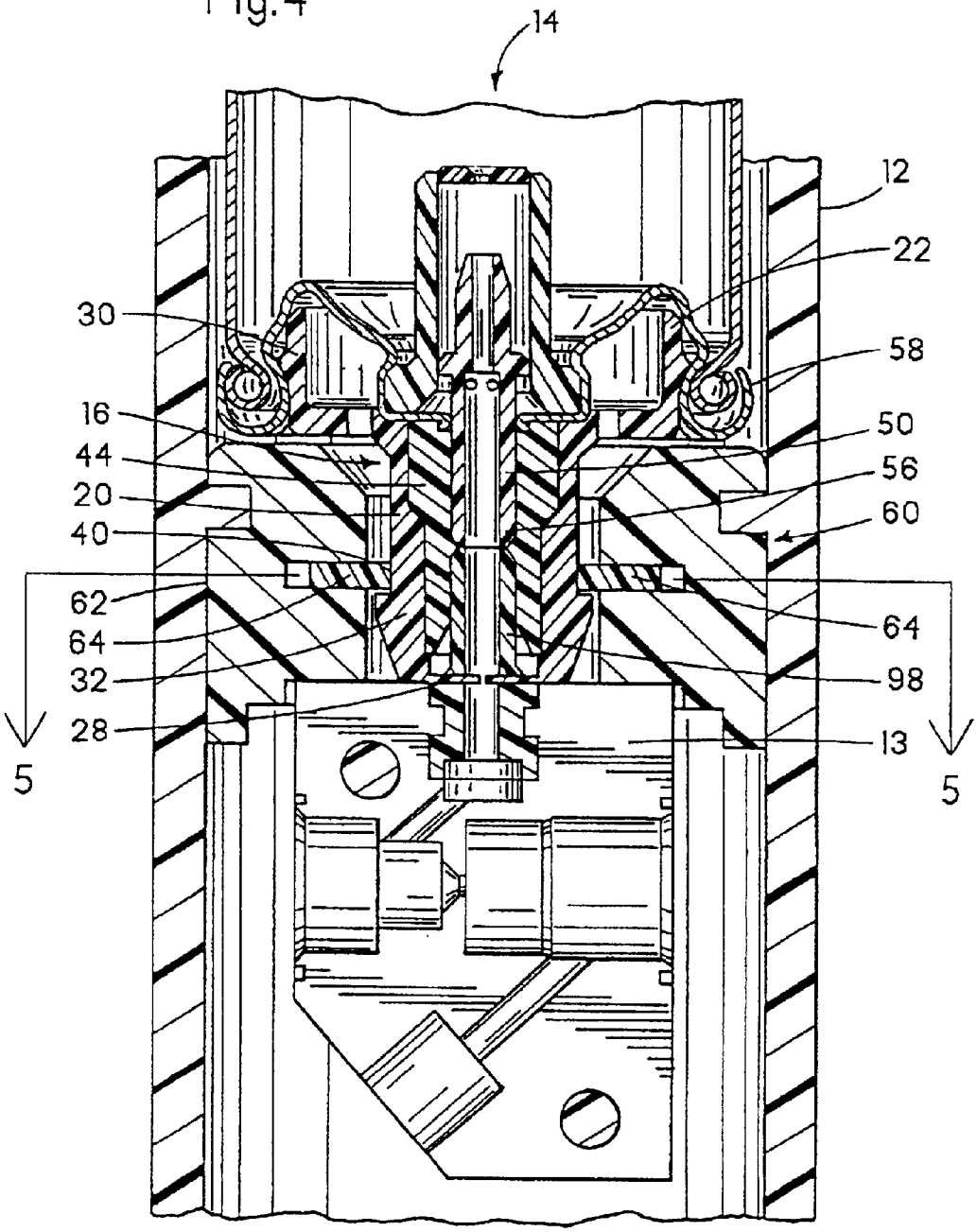
FIG. 4 is a fragmentary vertical sectional view of the present fuel cell adapter system depicting the adapter and molded insert seal engaged with the fuel cell, and the latch holding the adapter and fuel cell in the combustion tool.

To place the adapter 16 onto the fuel cell 14, the molded insert 44 is fitted into the adapter body 18 where it is accommodated in the passageway 26. The adapter 16 is placed onto the fuel cell stem 50 so that a tip 56 of the fuel cell stem (FIGS. 2, 3 and 4) slides into the molded insert 44 and lies in between the pair of internal sealing rings 54. In order to securely attach the adapter 16 onto the fuel cell 14, the base 22 is mechanically compressed and pushed downward onto a rolled seam 58 (FIGS. 2 and 3) of the fuel cell, so that the wedge 30 on the base hook under and frictionally engage the rolled seam. As seen in FIG. 4, the adapter 16 is securely fit onto the fuel cell 14 with the wedge 30 under the lip of the rolled seam 58.

With the adapter 16 in place on the fuel cell 14 and before the system is placed in a combustion tool 10, the frangible membrane 28 will still be intact (un-pierced) which gives the adapter the advantage of protecting the fuel cell during transportation. Because of this advantage, there is no need for a protective fuel cell cap. Another advantage is that the intact frangible membrane 28 gives visual identification that the fuel cell 14 is unused.

Referring now to FIGS. 1, 4, 5 and 6, the fuel cell 14 is provided with the adapter 16 and it is configured for being accommodated in the housing 11 to be in fluid communication with the fuel metering valve 13. The fuel metering valve 13 that is shown is only one of several embodiments that are known in the art. A feature of the present system is a latch 60, which can be seen in FIGS. 4, 5 and 6 that is disposed in the housing 11 for releasably securing the adapter 16 in fluid communication with the fuel metering valve 13.

Figure 5:
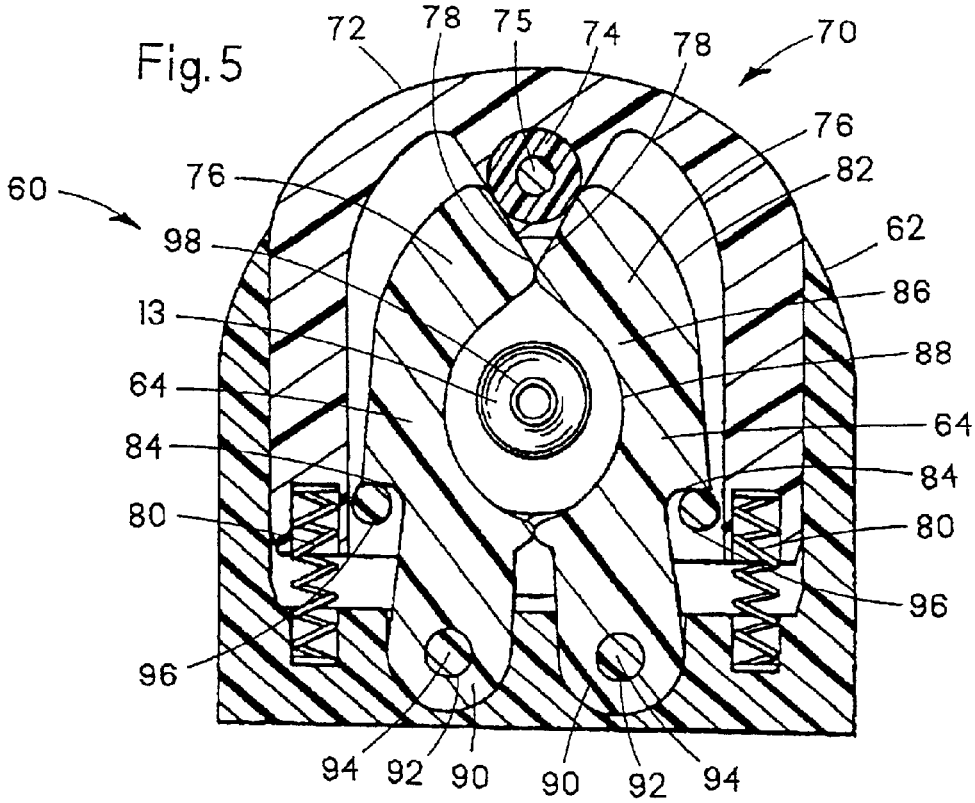
FIG. 5 is a sectional view taken along the line 5—5 in FIG. 4 in the direction generally indicated, showing the latch in the closed position.
Figure 6:
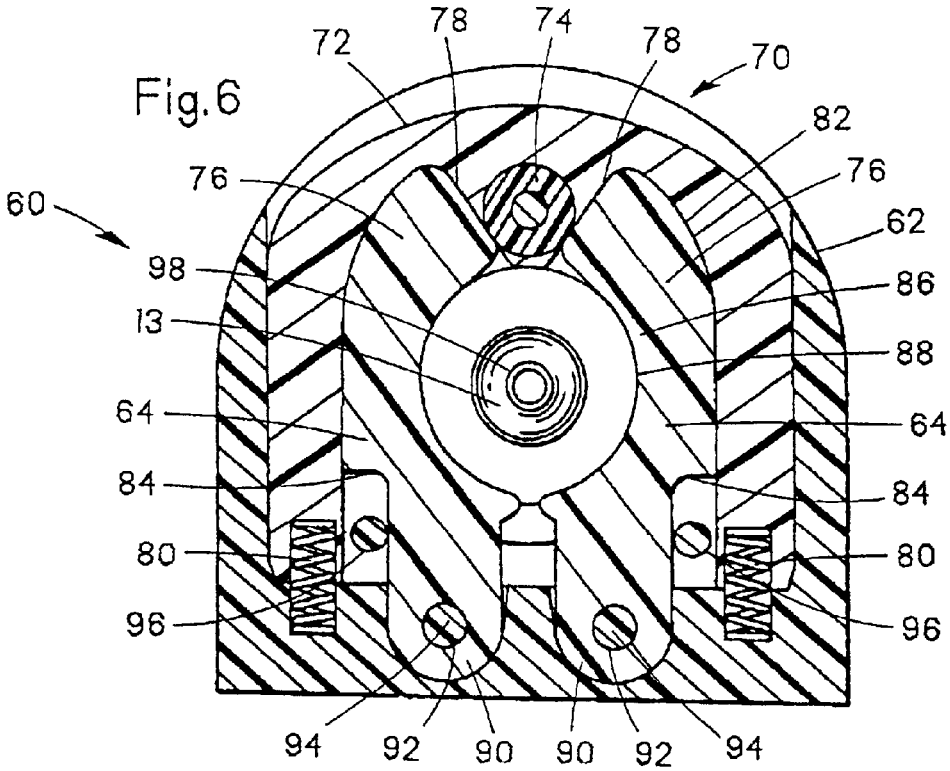
FIG. 6 is a sectional view taken along the line 5—5 in FIG. 4 in the direction generally indicated, showing the latch in the open position.

The latch 60 includes a latch body 62 having at least one and preferably two locking tangs 64 which are movable between a closed position (FIG. 5) and an open position (FIG. 6). In the closed position, the tangs 64 secure the adapter 16 in the housing 11. Also included is a release member 70 for moving the locking tangs 64 to release the engagement with the adapter 16 and to permit withdrawal of the fuel cell 14 from the tool 10. In the preferred embodiment of the latch 60 shown in FIGS. 5 and 6, the locking tangs 64 are biased to a closed position, although it is also contemplated that the locking tangs could be arranged to be biased in the open position. It is also preferred that the two locking tangs 64 in the latch 60 are disposed to be in an opposing relationship to each other.

Still referring to FIGS. 5 and 6, the preferred embodiment of the latch 60 is to have a push button 72 as the release member 70, with the push button having a generally circular raised boss 74 for engaging the locking tangs 64. The boss 74 is secured to the push button 72 by a friction fit with a lug 75, adhesive, or other fasteners that are well known in the art. Also in the preferred latch 60, each locking tang 64 has a contact end 76 with an inclined surface 78 for being progressively separated as the boss 74 is moved axially against a biasing force pressing the tangs to the closed position. In the preferred embodiment, the biasing force is provided by a pair of compression springs 80 located in a chamber 81 spanning the latch body 62 and the push button 72 to bias the button to an outward position. It is contemplated that the number, arrangement and strength of the springs may vary to suit the application.

In the latch 60, each locking tang 64 has an outside edge 82 defining a shoulder 84. There is also an inside edge 86 forming a surface 88 for engaging the groove-shaped gripping formation 40 of the adapter 16. In the preferred embodiment, the surface 88 is arcuate in shape to better grasp the generally circular nozzle 20. However, it is contemplated that the shape of the surface 88, and/or the edge 86 may change to positively engage alternative configurations of the gripping formation 40 as described above.

In FIGS. 5 and 6, the locking tangs 64 have a pivoting end 90 which is opposite the contact end 76. The pivoting end 90 has a hole 92 where a pivoting pin 94 is attached to the locking tangs 64, which holds them inside the latch body 62 and allows the locking tangs to pivotally move between the open and closed positions. Also in this embodiment, the push button 72 is provided with a pair of holding pins 96 which each engage and abut the shoulders 84 of the locking tangs 64 to bias them into the closed position as seen in FIG. 5. These holding pins 96 also retain the push button 72 from escaping the housing 11 under the force of the springs 80. The holding pins 96 also act as a stop for the locking tangs 64. As seen in FIG. 6, the locking tangs 64 are only allowed to pivotally open until the pivoting end 90 abuts the holding pin 96. Both the pivoting pins 94 and the holding pins 96 are disposed generally parallel to each other, and are generally normal to the plane defined by the locking tangs 64.

In operation, the assembled fuel cell 14 and the adapter 16 are placed into the fuel cell chamber 12 of the tool 10. Once inside the fuel cell chamber 12, the nozzle 20 will come into contact with the latch 60, and the operator will then press the fuel cell 14 inward. The ramped configuration of the lugs 32 spread the locking tangs 64 apart. When the truncated lug ends 36 pass by the biased locking tangs 64, the locking tangs will close, and the inside edge 86 will engage the groove or other configurations of the gripping formation 40 of the adapter 16, so that the lug ends are positioned above the locking tangs and the truncated rib ends 38 are positioned below the locking tangs. In this position, the adapter 16 is securely held inside the tool 10 (best seen in FIG. 4).

The fuel cell chamber 12 is seen in FIG. 4, where the fuel cell 14 and adapter 16 are locked in the latch 60. As the adapter 16 becomes locked in the latch 60, a fuel metering valve stem 98 pierces the frangible membrane 28 so that the fuel metering valve stem is aligned with, and preferably abuts the fuel cell stem 50 in between the pair of internal sealing rings 54. This arrangement enables sealed fluid communication between the fuel cell 14 and the fuel metering valve 13.

While in use, the frangible membrane 28 has the advantage of protecting the fuel cell 14 from dirt and other debris. Since the latch 60 holds the adapter 16 and the fuel cell 14 in an engaged position with the fuel metering valve 13, the entire adapter system is very compact and there is no need for a cell chamber back door, or end cap, as is found on some models of combustion tools.

When a user needs to remove the fuel cell 14 from the tool 10, he simply pushes the push button 72 inward against the springs 80, so that as the boss 74 is moved inward pushing against the inclined surfaces 78 of the locking tangs 64, it progressively separates the locking tangs until the pivoting ends 90 abut the holding pins 96, and the locking tangs disengage from the groove-shaped gripping formation 40. In this open position 68 (best seen in FIG. 6), the inside edges 86 of the locking tangs 64 form an opening large enough so that the lugs 32 of the adapter 16 are able to freely pass, and the fuel cell 14 can be removed from the fuel cell chamber 12. As the adapter 16 is pulled out of the fuel cell chamber 12 with the spent fuel cell 14, the fuel metering valve stem 98 leaves the frangible membrane 28 pierced, which visually shows that the fuel cell 14 has been used.

The design of the latch 60 is such that installation and removal of the fuel cell 14 is user friendly, and is comparable to installing and removing a battery of such combustion tools. Another advantage is that the adapter 16 cannot be removed from the fuel cell 14 without fracturing the support ribs 34, and therefore cannot be reused on another fuel cell.

Figure 9:
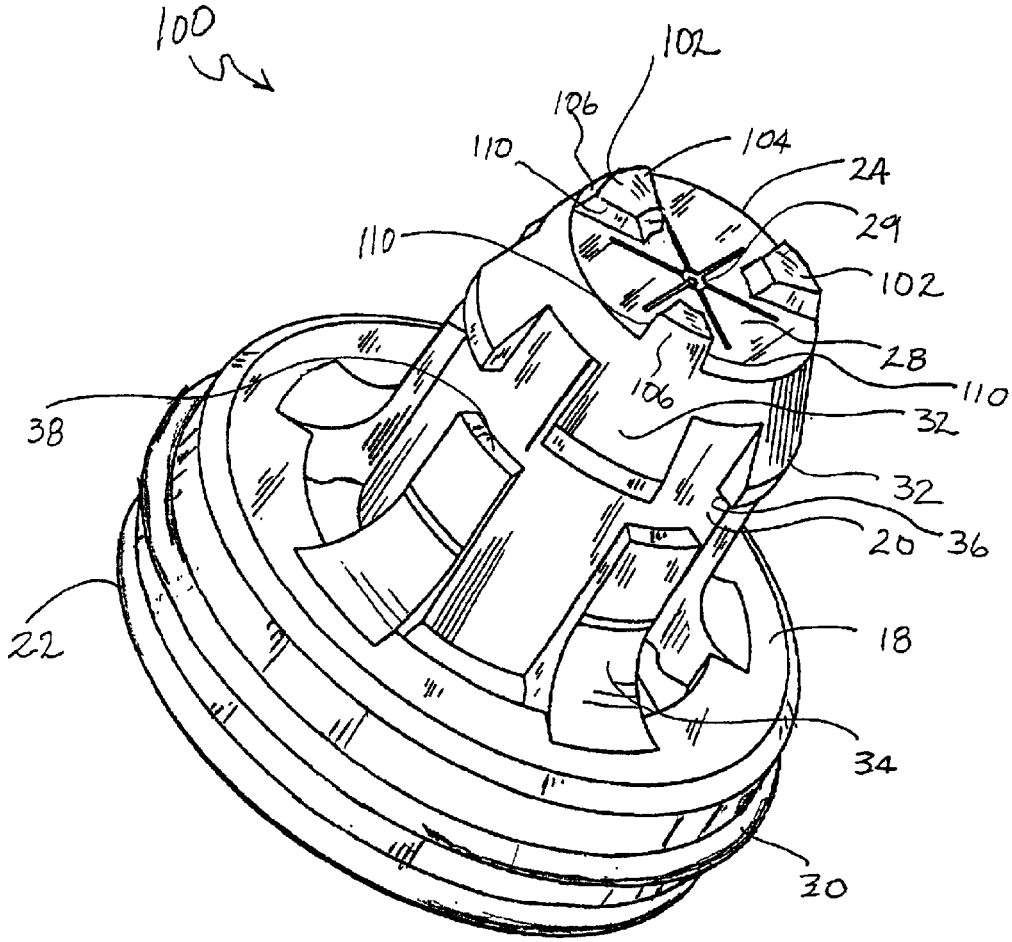
FIG. 9 is a front perspective view of an alternate embodiment of the present adapter.
Figure 10:
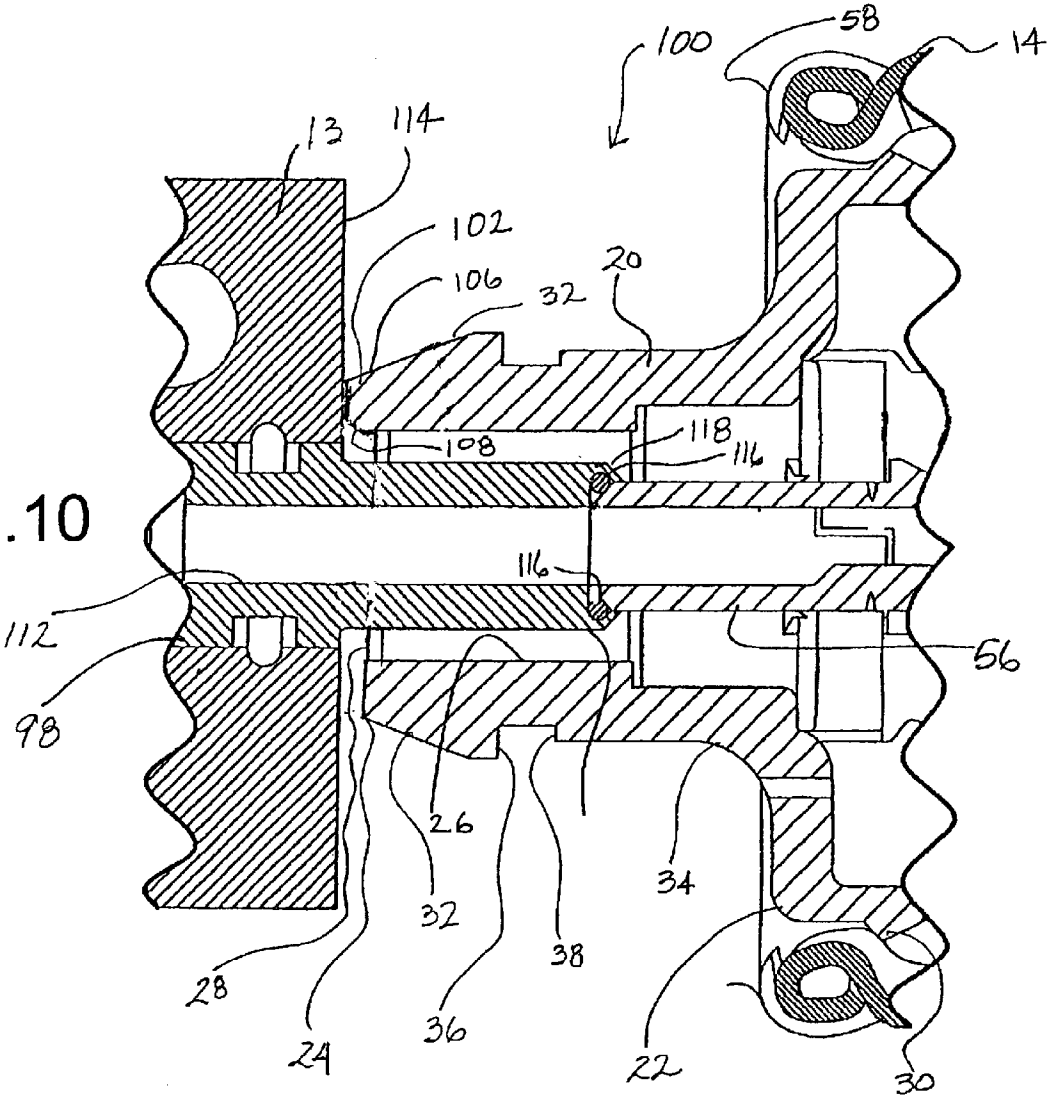
FIG. 10 is a fragmentary vertical sectional view of the embodiment of FIG. 9 depicting the adapter engaged with the fuel cell.

Referring now to FIGS. 9 and 10 an alternate embodiment of the present adapter is generally designated 100. The adapter 100 is similar to the adapter 16, and shared components are designated with identical reference numbers. It is contemplated that the adapter 100 incorporates all of the features of the adapter 16. One feature of the adapter 100 is that the free end 24 of the nozzle 20 is equipped with a plurality of lobes 102 that facilitate operational engagement upon the valve stem 98. In the preferred embodiment, there are three lobes 102, however it is contemplated that any number of lobes greater than two will be suitable.

Each of the lobes 102 has an upper end 104, an outer wall 106, an inner wall 108 and a pair of side walls 110. To save material and prevent the clogging of the opposing surfaces of the adapter 100 and the valve stem 98, the lobes 102 are circumferentially spaced about the free end 24. While not required, in the preferred embodiment, each of the lobes 102 is associated with a corresponding lug 32. Also, the inner walls 108 of the lobes 102 are chamfered in that they are inclined toward the membrane 28 to facilitate the appropriate coaxial engagement between the valve stem 98 and the nozzle 20. In other words, the inner walls perform a locating function for facilitating the engagement. Ultimately, the passageway 26 and a throughbore 112 of the valve stem 98 are in coaxial alignment to permit the transfer of fuel from the fuel cell 14 to the metering valve 13.

Another feature of the lobes 102 is that they each preferably have the same length projecting axially from the nozzle 20, or the distance from the frangible membrane 28 to the upper end 104. Upon assembly, the upper ends 104 engage an opposing surface 114 of the metering valve 13 (FIG. 10). In this manner, appropriate alignment of the fuel cell 14 and the metering valve 13 is obtained, while creating a spacing between the two components which the user can easily clear of debris or dirt by blowing, vacuuming, etc. It is also preferred that the lobes 102 are each aligned with or associated with a corresponding one of the lugs 32, and in the depicted embodiment, there is a lobe 102 associated with every other lug 32.

Another feature of the present adapter 100, which may also be found on the adapter 16, is that the spaced supporting ribs 34 are the fastening point of the nozzle 20 to the base 22 and are configured to provide a breakaway action if a user attempts to remove the adapter from the fuel cell 14. Upon shear failure of the ribs 34, the fuel cell adapter 100, 16 cannot be reused on another fuel cell 14, eliminating the introduction of dirt, debris, or impurities that can interfere with the connection during reuse. This single use nature of the present adapter 16, 100 also inhibits the use of refilled or generic fuel cells which may impede the optimal operation of the tool 10. It is contemplated that the shear failure of the support ribs 34 may be caused by varying the shape, size, thickness, and material composition of the ribs, or by adding scoring or other non-uniformities to the rib structure. The supporting rib structure 34 should include any other means known by one in the art to cause material failure at the rib location upon removal while maintaining sufficient strength to withstand the shock of combustion and the pressure of the gas propellant while in use.

The basic design parameter for the adapter is that the ribs 34 are configured so that the base 22 secures the adapter 16, 100 to the fuel cell 14 more securely than the radially-spaced ribs 34 secure the nozzle to the base 22. Thus, upon an attempt to dislodge the adapter from the fuel cell, and a torquing force exerted on the nozzle 20, the nozzle breaks free of the base. One factor in securing the base 22 to the fuel cell more rigidly than the nozzle 20 is held to the base is by configuring the periphery of the base to have at least one barb or wedge 30 formed on said base and configured for frictionally engaging the fuel cell. In the preferred embodiment, the wedge 30 is disposed on the periphery of the exterior of the base 22 and is of slightly greater diameter than the inside diameter of the fuel cell 14. Upon compression and mechanical placement, the wedge 30 fits in tight configuration with the fuel cell below the rolled seam 58 fixedly engaging the base to the fuel cell 14. If desired, the opposing ends of the metering valve stem 98 and the fuel cell tip 56 may be provided with a seal 116 such as an O-ring. The seal 116 is retained to one of the stem 98 or the tip 56 by a capture formation 118 or other known fastening technology.

Figure 11:
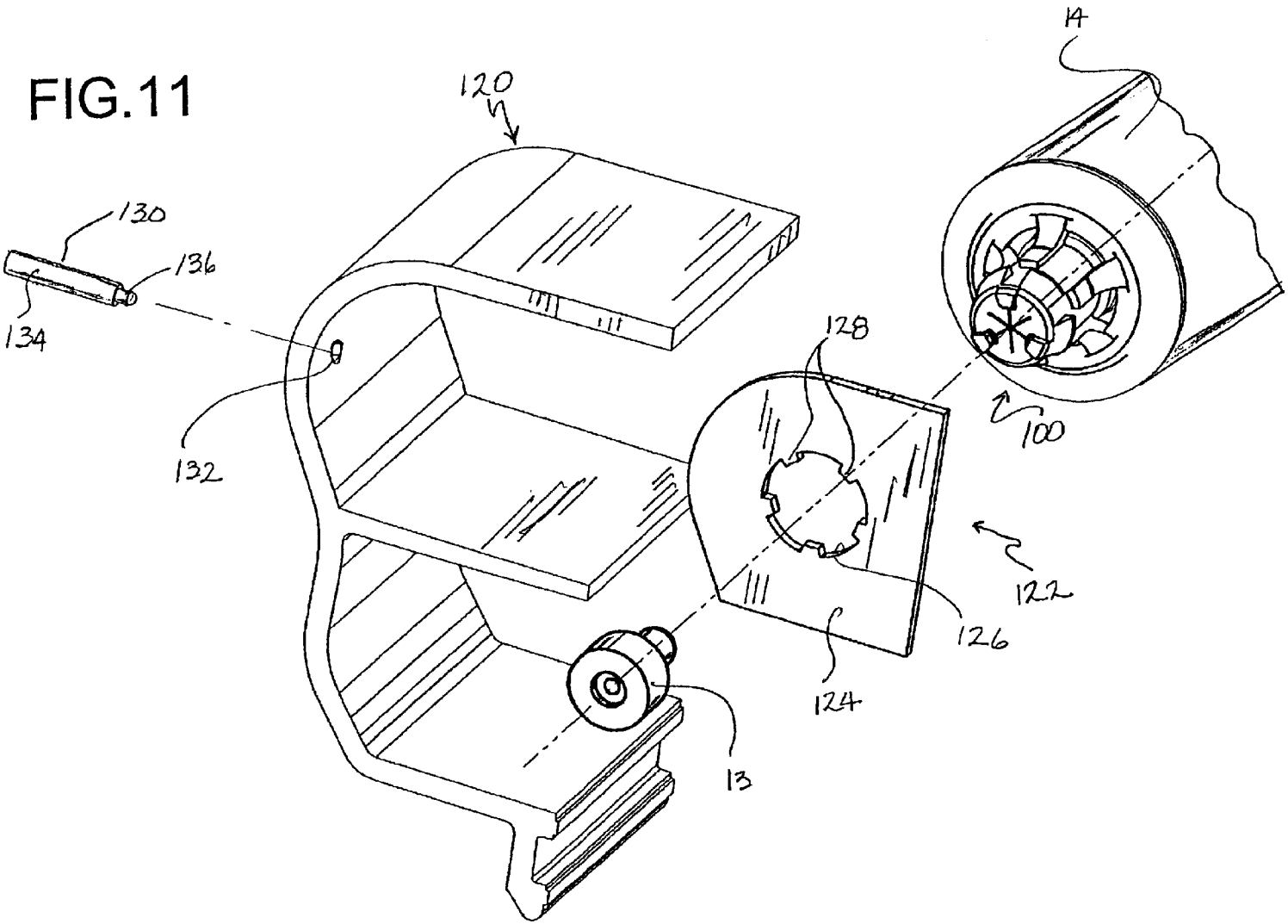
FIG. 11 is an exploded perspective view of an alternate embodiment of the present tool featuring an adapter locking mechanism.
Figure 12:
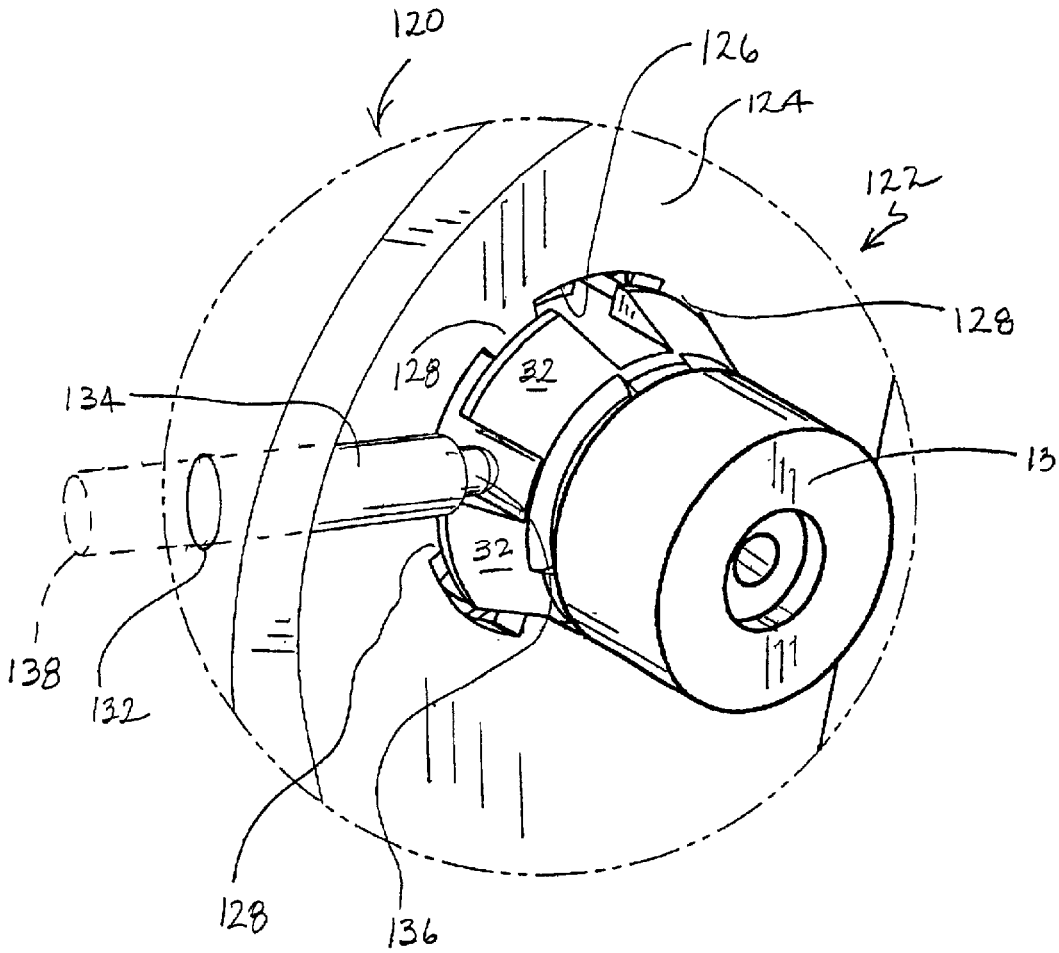
FIG. 12 is an assembled view of the embodiment of FIG. 11.

Referring now to FIGS. 11 and 12, an alternate embodiment of the tool housing 11 is generally designated 120 which is contemplated as being compatible with the above-described adapter 16, 100 and other operational aspects of the tool 10, and features a releasable locking mechanism 122 which securely retains the fuel cell adapter 16, 100 in operational position relative to the fuel metering valve 13. At the same time, the locking mechanism 122 is configured to permit easy insertion and withdrawal of the fuel cell by the user.

More specifically, the locking mechanism 122 forms a latch for releasably securing the adapter 16, 100 in fluid communication with the fuel metering valve 13. Included in the locking mechanism is a bracket 124 configured to receive the non-circular profile portion of the adapter 16, 100, which includes the nozzle 20 and the lugs 32. The bracket 124 is made of a suitably rigid material such as metal or plastic and is secured within the housing 11 by a pressure fit, ultrasonic welding, chemical adhesives, a suitable groove or any other suitable conventional attachment technology. Also, it will be understood that the bracket 124 is positioned within the housing 120 so that upon engagement with the adapter 16, 100, proper alignment and fluid communication is achieved between the adapter and the fuel metering valve 13.

In the preferred embodiment, the bracket 124 has a plate-like configuration defining an opening 126 with a plurality of inwardly radially projecting spaced teeth or tabs 128. The tabs 128 are constructed and arranged so that the lugs 32 of the adapter 16, 100 can pass between adjacent tabs when the adapter is inserted or withdrawn. Upon axial rotation of the adapter 16, 100 by the user, the tabs 128 engage the lugs 36, preferably at the lug ends 36, to prevent withdrawal of the adapter from the housing 120 or from engagement with the fuel metering valve 13.

An additional feature of the locking mechanism is at least one biased locking member 130 for releasably retaining the adapter 16, 100 in engagement with the fuel metering valve 13 once the adapter has been engaged in the bracket 124.

More specifically, the locking member 130 is constructed and arranged for preventing unwanted rotation or withdrawal of the adapter 16, 100 during operation of the tool. By the same token, the locking member 130 is configured for permitting the release and removal of the adapter 16, 100 and the fuel cell 14 when necessary, such as when the fuel cell needs replacement.

As seen in FIGS. 11 and 12, the locking member 130 is secured in the housing 120, as by being inserted in a friction fit through a corresponding opening 132. Additional means may be used to secure the locking member 130 in the housing, including, but not limited to, locknuts, chemical adhesives, ultrasonic welding and the like. The locking member 130 is oriented to engage the adapter 16, 100 once it has been inserted through the opening 126 and has been rotated sufficiently to provide engagement between the lugs 32 and the tabs 128. In the preferred embodiment, the locking member 130 engages the adapter between adjacent lugs 32.

The preferred construction of the locking member 130 is a barrel or tube 134 in which a tip 136 reciprocates under a biasing force, such as provided by a spring (not shown). Upon insertion of the adapter 16, 100 through the opening 126, the tip 136 is depressed by the lugs 32 overcoming the biasing force. Once the adapter 16, 100 is rotated, the lugs move and the tip can extend between the space between adjacent lugs (best seen in FIG. 12). It is also contemplated that the locking member 130 could be constructed so that the pin was connected to a knob 138 (shown in phantom in FIG. 12) which is accessible by a user to achieve manual release of the locking member prior to withdrawal of the fuel cell 14.

In operation of the embodiment of FIGS. 11 and 12, the user merely pushes the fuel cell 14 with the adapter 16, 100 into the housing so that the nozzle 20 engages the opening 128 in a way that the lugs 32 pass between the tabs 128. The user then rotates the fuel cell 14 so that the lugs 32 engage the tabs 128 and the adapter 16, 100 is then in operational position. The biasing force of the locking member 130 is such that movement of the adapter 16, 100 is prevented during normal tool operation. Once the user rotates the fuel cell 14 for removal, the biasing force is overcome and the tip 136 retracts.

Thus, it will be seen that the present fuel cell adapter 16 and latch 60 provides an improved fuel cell adapter system that protects the fuel cell stem 50 during transportation, and also protects the fuel cell 14 from dirt and other debris while the tool 10 is in use. This improved fuel cell adapter system also keeps the whole system compact and makes installation and removal of the fuel cell 14 user friendly. Further, the present invention identifies if the fuel cell is unused or not, and also the adapter cannot be reused on a generic fuel cell.

While particular embodiments of the fuel cell adapter system has been shown and described, it will be appreciated by those skilled in the art that changes and modifications may be made thereto without departing from the invention in its broader aspects and as set forth in the following claims.

What is claimed is:

1. A combustion tool comprising:

a housing enclosing a fuel metering valve;

a fuel cell non-removably fixed to an adapter such that said adapter is configured to fracture if rotational removal from said fuel cell is attempted, and configured for being accommodated in said housing in fluid communication with said fuel metering valve; and a latch disposed in said housing for releasably securing said adapter in said fluid communication with said fuel metering valve, such that said fuel cell is retained in said housing by said engagement of said adapter with said latch.

2. The tool of claim 1 wherein said adapter comprises a nozzle and a base, said nozzle and said base being fastened together by a plurality of supporting ribs, said supporting ribs being configured for preventing removal of said adapter from said fuel cell by undergoing said shear failure if such rotational removal is attempted.

3. The tool of claim 1 wherein said adapter has a non-circular profile portion, and said latch includes a bracket configured to accommodate said non-circular profile portion upon insertion or removal of said adapter, and upon rotation of said adapter, said bracket is configured for preventing the removal of said adapter from the tool.

4. The tool of claim 3, wherein said non-circular profile portion includes a plurality of circumferentially spaced lugs, and said bracket defines an opening with a plurality of inwardly radially projecting spaced tabs, said tabs being constructed and arranged so that said lugs can pass between them when said adapter is inserted or withdrawn, and upon rotation of said adapter, said tabs engage said lugs to prevent withdrawal of said adapter.

5. The tool of claim 1 wherein said latch includes at least one biased locking member for releasably retaining said adapter in engagement with said fuel metering valve.

6. The tool of claim 5, wherein said latch includes a bracket configured to receive and retain said adapter in a push-and-rotate motion, said locking member is constructed and arranged to engage said adapter to prevent rotation of said adapter.

7. The tool of claim 6, wherein said adapter has a plurality of spaced peripheral lugs, and said locking member engages said adapter between adjacent lugs.

8. The tool of claim 6 wherein said locking member exerts a biasing force against said adapter which can be overcome by manual twisting of said fuel cell.

9. The tool of claim 6 wherein said locking member is manually releasable to permit release of said fuel cell.

10. The tool of claim 1 wherein said latch includes a latch body having at least one locking tang movable between a closed position and an open position; and a release member for moving said at least one locking tang to release said engagement with said adapter and permitting withdrawal of said fuel cell from said tool.

11. A combustion tool comprising:

a housing enclosing a fuel metering valve;

a fuel cell provided with an adapter and configured for being accommodated in said housing in fluid communication with said fuel metering valve;

a latch disposed in said housing for releasably securing said adapter in said fluid communication with said fuel metering valve;

said adapter has a non-circular profile portion, and said latch includes a bracket configured to accommodate said non-circular profile portion upon insertion or removal of said adapter, and upon rotation of said adapter, said bracket is configured for preventing the removal of said adapter from the tool; and said non-circular profile portion includes a plurality of circumferentially spaced lugs, and said bracket defines an opening with a plurality of inwardly radially projecting spaced tabs, said tabs being constructed and arranged so that said lugs can pass between them when said adapter is inserted or withdrawn, and upon rotation of said adapter, said tabs engage said lugs to prevent withdrawal of said adapter.

12. A combustion tool comprising:

a housing enclosing a fuel metering valve;

a fuel cell provided with an adapter and configured for being accommodated in said housing in fluid communication with said fuel metering valve;

a latch disposed in said housing for releasably securing said adapter in said fluid communication with said fuel metering valve;

said latch includes at least one biased locking member for releasably retaining said adapter in engagement with said fuel metering valve; and said latch includes a bracket configured to receive and retain said adapter in a push-and-rotate motion, said locking member is constructed and arranged to engage said adapter to prevent rotation of said adapter.

* * * * *